United States Patent [19]

Jolley

[11] 3,968,483

[45] July 6, 1976

[54] BURGLAR AND FIRE ALARM SYSTEM

[76] Inventor: Leonard Jolley, 665 SE. Terra Circle, Corvallis, Oreg. 97330

[22] Filed: Jan. 8, 1975

[21] Appl. No.: 539,295

[52] U.S. Cl. ..... 340/274 R; 75/151 R
[51] Int. Cl.[2] ..... G08B 13/08
[58] Field of Search ..... 340/63, 273, 274 R, 340/275, 276, 282, 420; 70/151 R

[56] References Cited

UNITED STATES PATENTS

| | | | |
|---|---|---|---|
| 3,353,383 | 11/1967 | Fish | 340/274 X |
| 3,569,928 | 3/1971 | Avallone | 340/274 X |

*Primary Examiner*—Alvin H. Waring
*Attorney, Agent, or Firm*—Klarquist, Sparkman, Campbell, Leigh, Hall & Whinston

[57] ABSTRACT

A security alarm system for a building includes rechargeable battery-operated alarm circuitry, with the system including a burglar alarm in conjunction with an entrance door. Inside switches selectively activate the system and operate an electric motor to slide a door bolt between open and closed positions. With the door bolt closed, anyone attempting to retract the door latch closes a latch-operated switch in the alarm circuit, setting off the alarm. Magnetic switches embedded within the outside wall of the building at secret locations are operable from outside the building by touching the proper pole of a magnet to the proper secret spot on the wall to close the bolt and activate the system or open the bolt and deactivate the system to permit authorized entry from outside. The system also includes heat-sensing switch means in the alarm circuit for sounding the alarm in the event of fire, smoke or heat without the necessity of activating the magnetic or inside switches.

9 Claims, 4 Drawing Figures

BURGLAR AND FIRE ALARM SYSTEM

BACKGROUND OF THE INVENTION

1. Field of the Invention

The present invention relates to a combination burglar-fire alarm system for a building and more particularly to such a system having a burglar alarm in conjunction with the entrance doors of the building.

2 Description of the Prior Art

Many persons have suggested the concept of a combination burglar and fire alarm system for a building including a burglar alarm operable in conjunction with the entrance doors of the building. Examples of such prior systems most pertinent to the concepts of the present invention are those shown in U.S. Pat. Nos. 3,404,393; 3,631,444; and 3,686,668. However, most of such prior systems are so complex, sophisticated and thus expensive, and so difficult to install that they are beyond the economic reach of the average homeowner.

SUMMARY OF THE INVENTION

Primary objectives of the present invention are to provide an alarm system that is of simplified construction and therefore not subject to malfunction; relatively foolproof in operation to prevent a would-be burglar from defeating the system; packaged as a unit for easy installation in existing buildings; adaptable to existing door-locking systems in common use; and of low cost.

The invention features an electrical storage battery-operated alarm system, with the batteries being rechargeable from building current. The system also features an electric motor-operated door bolt which, when open, de-energizes the alarm system and when closed conditions the alarm system for operation.

The burglar alarm portion of the system features a door latch-operated switch which is open when the latch is extended to hold the door closed, but which closes the alarm circuit and sounds the alarm when the door latch is retracted in an attempt to open the door with the bolt closed.

The fire alarm portion of the system includes a series of heat- or smoke-sensitive switches connected in parallel with the door latch-operated switch in the alarm circuit, any one of which, when closed, also sounds the alarm.

The door bolt, the position of which determines the condition of the alarm system, can be operated either from inside the building using a manually operated switch or from outside the building using a magnet or other appropriate activator applied to a secret spot on, for example, the outside wall of the building to close a magnetic or other remotely operable switch embedded beneath such spot.

The foregoing objects, features and advantages of the present invention will become more apparent from the following detailed description, which proceeds with reference to the accompanying drawings.

Figure 2:
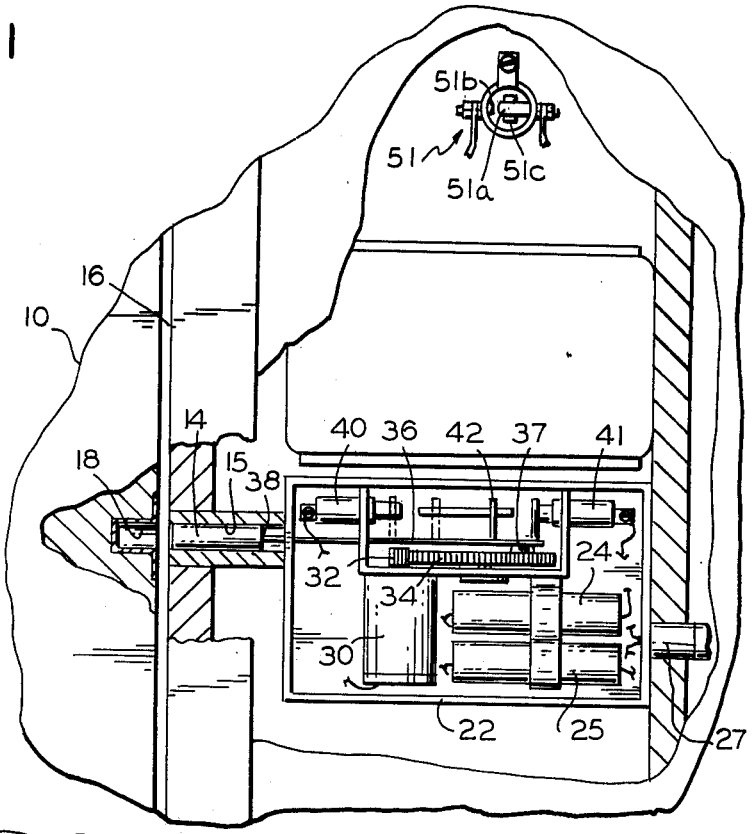
FIG. 2 is a fragmentary view partly broken away and partly in section showing on an enlarged scale the lock portions of the entrance door and the major portions of the alarm system housed within the building wall adjacent the entrance door.

With reference to the drawings, the alarm system of the invention is adapted for use with an entrance door 10 for a building, such door being equipped with a conventional door-locking system including a locking-type door handle or knob 11 having a knob-operated latch 12, shown in FIG. 2.

The locking system also includes a door bolt 14 slidable from its slideway 15 within the wall 16 adjacent to the entrance door into a recess 18 within the free edge of the door. A burglar-fire alarm 20 (FIG. 1), electrically operated, is mounted near the door or at any other convenient location. In fact, the alarm means may include both the inside alarm 20 and an outside alarm (not shown).

The primary components of an electromechanical system for operating the alarm and the door bolt are packaged as a unit in a compact housing 22 within the wall 16 adjacent entrance door 10. Such housing includes a battery power source including two batteries 24, 25 with their terminals reversed with respect to one another for a purpose to be described. The battery power source is provided with a selectively operable charger 27 operated from a building's normal electrical wiring system.

The batteries power an electric motor 30 within housing 22 for sliding door bolt 14 in opposite directions between its open or retracted position shown in FIG. 2 and a closed or extended position (not shown) through a drive means. The drive means includes a pinion gear 32 on the motor drive shaft, a large bull gear 34 driven by the pinion, and a bolt-actuating arm 36 pinned eccentrically to an outer face of the bull gear at 37 and pinned at its opposite end at 38 to the bolt. Limit switch means including a pair of limit switches 40, 41 operated by a limit switch actuator 42 on bolt-actuating arm 36 limit travel of the door bolt in either direction by limiting the number of revolutions of the motor in either direction.

Figure 4:
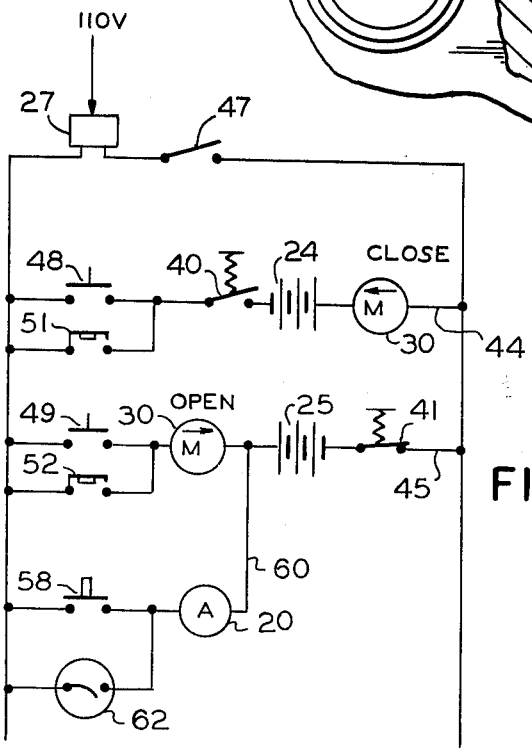
FIG. 4 is an electrical circuit diagram of the alarm system.

It will be apparent from FIG. 4 that motor 30 is connected in two different motor circuits, a first motor circuit 44 including battery 24 and a second motor circuit 45 including battery 25. Since the terminals of the two batteries are reversed with respect to one another, when motor circuit 44 is closed, the motor operates in a direction to close door bolt 14. However, when the second motor circuit is closed, battery 25 causes the motor to operate in the opposite direction to open the bolt.

Figure 1:
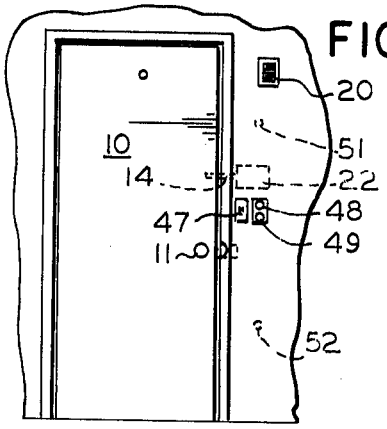
FIG. 1 is an elevational view of the inside of an entrance door to a building showing a portion of the wall surrounding such entrance door and portions of the alarm system of the present invention.

Three manually operated switches are provided inside the building, preferably on the inside wall adjacent to entrance door 10 as shown in FIG. 1. This inside switch means includes a toggle-type master switch 47 to energize the overall electrical circuit for the system and first and second pushbutton switches 48, 49, in motor circuits 44 and 45, respectively, to activate the motor and thus bolt 14 in opposite directions.

Figure 3:
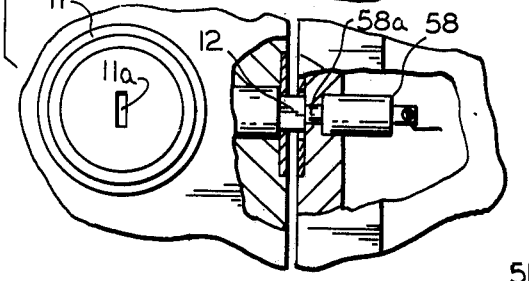
FIG. 3 is a fragmentary sectional view of a portion of the outside wall of the building adjacent the entrance door showing a magnetic switch portion of the alarm system embedded within such outside wall.
Figure 3:
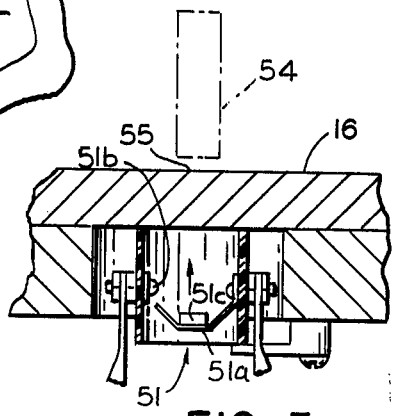

Also connected in each motor circuit in parallel with pushbutton switches 48, 49 are magnetically operated switches 51, 52. As shown in FIG. 3 with respect to magnetic switch 51, each magnetic switch is embedded within the outside wall of the building at any desired "secret" location, preferably somewhere near the entrance door, to enable only an authorized person to activate the system after leaving the building and to deactivate the system before entering the building. This is done by touching the appropriate pole of a small but strong magnet 54 to the secret spot on the building wall aligned with the proper magnetic switch to accomplish the desired result.

Referring to FIG. 3, each magnetic switch 51, 52 includes a spring metal switch arm 51*a* biased to an open position spaced from a switch contact 51*b* and carrying a quantity of magnetic material 51*c*. A suitable magnetic material for the switch element 51*c* and the switch actuator 54 is a so-called "lodestone," a naturally occurring magnetic stone. Although magnetically operated switches are convenient and relatively inexpensive to use for outside actuation of the system, switches operable by other means capable of penetrating the wall could also be used for this purpose, such other means including sound, laser, or radio waves.

The burglar alarm portion of the system also includes a door latch-operated switch 58. Such switch is normally maintained in an open position when the door latch 12 is extended between the door and the wall to hold the door closed. In such latched position, the free end of the latch contacts the latch switch actuator 58*a* which maintains the switch open. However, whenever latch 12 is retracted, such as by turning the doorknob, switch actuator 58*a* is released to close the switch and complete the alarm circuit 60. Alarm circuit 60 is in parallel with motor circuit 45 but in series with limit switch 41 and battery 25. Thus with the system activated, any unauthorized tampering with doorknob 11 or latch 12 causing the latch to retract, closes switch 58 completing the alarm circuit and sounding the alarm.

Also provided in the alarm circuit is a series of heat or smoke sensitive switches 62 connected in parallel with the door latch switch 58 but in series with alarm 20 and battery 25 so that the closing of any one of such switches will sound the alarm.

To activate the system from inside the building, master switch 47 is turned on and pushbutton switch 48 in line 44 is closed, completing first motor circuit 44 through normally closed limit switch 40, battery 24, and motor 30. Motor 30 thus operates to close bolt 14 and continues to operate until limit switch actuator 42 contacts limit switch 40, moving such limit switch to its open position and thereby breaking motor circuit 44 and shutting off the motor. The door is now locked. An additional conventional doorknob lock would normally be provided to lock the latch 12 in its extended position through the use of a key in the keyway 11*a* of doorknob 11.

With latch 12 in its extended position, latch switch 58 is engaged by the latch and thus maintained in its open position in alarm circuit 60, which is otherwise conditioned to operate by normally closed limit switch 41. Thereafter anyone tampering with latch 12 in attempting to withdraw it from its locked position, either by turning doorknob 11 or by otherwise withdrawing the latch from its wall recess, closes switch 58, completing alarm circuit 60 through limit switch 41 and battery 25 to sound the alarm 20.

With the bolt closed and thus the alarm circuit conditioned to operate, anyone wishing to exit from the building through door 10 must first deactivate the system by pressing pushbutton 49. This completes the second motor circuit 45 through limit switch 41 and battery 25 to slide bolt 14 to its open position. With bolt 14 open limit switch actuator 42 contacts limit switch 41 to open it, thereby not only breaking motor circuit 45, but also breaking alarm circuit 60. With the bolt open, latch 12 can be withdrawn to open the entrance door 10 without sounding the alarm.

To activate the alarm system from outside the building, master switch 47 must remain in its "on" position. With the entrance door 10 closed, a person desiring to lock the door and activate the alarm system from outside takes his small lodestone magnet, which may be on his keychain, and touches the proper pole of such magnet to the secret spot 55 on the wall of the building aligned with the embedded magnetic switch 51. This closes such switch, completing motor circuit 44 through limit switch 40, battery 24 and motor 30 to operate the motor in a direction to slide bolt 14 to its closed, locking position. When the bolt is in its locked position, switch actuator 42 contacts limit switch 40 to open such switch, thus breaking circuit 44 and shutting off motor 30. As the bolt moves from its open to its closed position, limit switch 41 in motor circuit 45 closes, conditioning both the second motor circuit 45 and the alarm circuit 60 for operation via magnetic switch 52 and latch switch 58, respectively. Thereafter any unauthorized person trying to gain entry through door 10, in turning knob 11 or otherwise trying to withdraw latch 12 from its extended position, would close latch switch 58 completing the alarm circuit 60 and sounding the alarm.

Any authorized person wishing to gain entry through entrance door 10 would know the secret location of the embedded magnetic switch 52, and would also have his magnetic switch actuator with him. The proper pole of such magnet is touched to the secret spot on the building wall aligned with embedded switch 52, thereby closing motor circuit 45 through closed limit switch 41 and battery 25 to operate the motor in a direction to open bolt 14. At the same time, limit switch actuator 42 contacts limit switch 41, moving such switch to its open position to break the second motor circuit, thereby also deactivating alarm circuit 60. Thereafter the authorized person can gain entry through the door 10 by using his conventional key to unlock latch 12 without sounding the alarm.

Heat sensors 62 are connected in the alarm circuit 60 in parallel with door latch switch 58. Therefore any excess heat detected within the building from any one of such sensors while the door bolt is closed completes alarm circuit 60 through limit switch 41 and battery 25 to sound the alarm regardless of the condition of latch 12.

With the foregoing-described alarm system, it will be apparent that a relatively simple, yet foolproof alarm system is provided that can be easily installed in existing buildings and used with conventional door-locking devices. It should also be apparent that the system can be applied to any number of entrance doors and with slight modifications could be adapted for use with building windows as well. It should also be understood that the electrical circuit is illustrative only, and various other electrical circuits could be used to accomplish the same purpose. Nevertheless, the illustrated system is preferred because of its simplicity and its use of low-cost components.

Having illustrated and described what is presently the preferred embodiment of the invention, it should be apparent to those skilled in the art that the same permits of modification in arrangement and detail. I claim as my invention all such modifications as come within the true spirit and scope of the following claims.

I claim:

1. In a burglar alarm system adapted for use with an entrance door of a building, and with said door including a door-locking system including a door handle-operated latch movable between retracted and extended positions between said door and an adjacent wall of said building, and a door bolt slidable between a retracted position and an extended locking position between said door and said wall, said alarm system including:

electrically operated alarm means connected in an electrical alarm circuit, reversible electric motor means, connected in an electrical motor circuit means, drive means interconnecting said motor means and said bolt for sliding said bolt between said extended and retracted bolt positions, limit switch means for deactivating said motor means and limiting sliding movement of said bolt in opposite directions, switch means accessible from inside said building including master switch means for energizing said system and motor switch means in said motor circuit means for operating said motor means in a selected direction to slide said bolt, door latch-operated switch means in said alarm circuit operable with said latch retracted, said bolt extended, and said master switch means closed to energize said alarm means and operable with said latch extended to de-energize said alarm means, and hidden switch means embedded at a secret location on or adjacent said building and operable by an actuator means directed toward said switch means from outside said building, said hidden switch means being in said motor circuit means in parallel with said motor switch means for operating said motor means and sliding said bolt between its extended and retracted positions.

2. The system of claim 1 including normally open heat- or smoke-sensitive switch means in said alarm circuit and in parallel with said door switch means for closing said alarm circuit upon sensing a predetermined high temperature within said building, whereby said system serves as a combined burglar and fire alarm system.

3. The system of claim 1 wherein said alarm system is battery operated and includes electrical storage battery means and recharge means operated from an electrical system of said building for selectively recharging said battery means.

4. The system of claim 1 wherein said motor means, drive means, and limit switch means are contained within a common housing means, said housing means being mounted within said building wall.

5. The system of claim 1 wherein said alarm means and said door switch means of said alarm circuit are electrically connected in series with said limit switch means and in parallel with said magnetic switch means and said motor switch means.

6. The system of claim 1 wherein said motor circuit means includes first and second motor circuits, said motor switch means includes a pair of motor switches one in each motor circuit, said limit switch means includes a pair of limit switches one connected in series with each motor switch, said hidden switch means includes a pair of magnetic switches one in each motor circuit in parallel with one of said motor switches, said first motor circuit being operable by either a first said motor switch or a first said magnetic switch in said first motor circuit to operate said motor means in a direction to extend said door bolt, said second motor circuit being operable by either a second said motor switch or a second said magnetic switch in said second motor circuit to operate said motor means in a direction for retracting said door bolt.

7. The system of claim 6 including storage battery means providing a source of electrical power for said system including a first battery connected in series with said first motor and magnetic switches and said motor means and a first said limit switch, and a second battery with its terminals reversed with respect to the terminals of said first battery and being connected in series with said second motor and magnetic switches and a second said limit switch and said motor means.

8. The system of claim 7 wherein said alarm circuit including said door switch and said alarm means is connected in parallel with said second motor switch and said second magnetic switch of said second motor circuit and in series with said second limit switch and said second battery.

9. The system of claim 1 wherein said drive means includes a motor shaft, a pinion gear on said motor shaft, a bull gear driven by said pinion gear, an eccentric arm pinned at one end to said bull gear, the opposite end of said eccentric arm being pinned to an inner end of said door bolt, and a limit switch actuator means carried by said drive means.

* * * * *